US008414062B2

(12) United States Patent
Gobart et al.

(10) Patent No.: US 8,414,062 B2
(45) Date of Patent: Apr. 9, 2013

(54) MULTI-PHASE CLOSURE CHECK LINK MECHANISM

(75) Inventors: James G. Gobart, Rochester, MI (US); Thomas E. Houck, Bloomfield Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 55 days.

(21) Appl. No.: 13/198,318

(22) Filed: Aug. 4, 2011

(65) Prior Publication Data

US 2013/0031747 A1 Feb. 7, 2013

(51) Int. Cl.
*E05F 5/02* (2006.01)

(52) U.S. Cl.
USPC ..... 296/146.4; 16/82

(58) Field of Classification Search ..... 16/49, 50, 16/65, 82, 86 R, 86 A, 86 B, 86 C; 49/139; 296/146.4, 146.9
See application file for complete search history.

(56) References Cited

U.S. PATENT DOCUMENTS

| | | | | |
|---|---|---|---|---|
| 2,032,600 | A * | 3/1936 | Smith | 16/86 C |
| 5,074,010 | A * | 12/1991 | Gignac et al. | 16/334 |
| 5,727,287 | A * | 3/1998 | Hosken et al. | 16/82 |
| 5,862,570 | A * | 1/1999 | Lezuch et al. | 16/82 |
| 6,370,733 | B2 * | 4/2002 | Paton et al. | 16/86 C |
| 6,557,924 | B2 * | 5/2003 | Lauderbach et al. | 296/146.4 |
| 6,564,425 | B2 * | 5/2003 | Audisio | 16/86 B |
| 6,584,642 | B2 * | 7/2003 | Hodson | 16/85 |
| 6,711,778 | B2 * | 3/2004 | Sparkman | 16/86 C |
| 6,901,630 | B2 * | 6/2005 | Liang et al. | 16/82 |
| 7,240,399 | B2 * | 7/2007 | Murayama et al. | 16/82 |
| 7,739,836 | B2 * | 6/2010 | Keane et al. | 49/339 |
| 7,784,841 | B2 * | 8/2010 | Watson et al. | 292/336.3 |
| 7,908,709 | B2 * | 3/2011 | Cruz et al. | 16/86 C |
| 2007/0245517 | A1 * | 10/2007 | Kiefer et al. | 16/52 |
| 2007/0245519 | A1 * | 10/2007 | Woo | 16/86 C |
| 2009/0072582 | A1 * | 3/2009 | Elliott et al. | 296/146.11 |
| 2012/0233813 | A1 * | 9/2012 | Settsu et al. | 16/82 |

FOREIGN PATENT DOCUMENTS

JP 06156083 A * 6/1994

* cited by examiner

*Primary Examiner* — Glenn Dayoan
*Assistant Examiner* — Paul Chenevert
(74) *Attorney, Agent, or Firm* — Quinn Law Group, PLLC

(57) ABSTRACT

A check link mechanism for a closure pivotally connected to a vehicle. The check link mechanism includes a check link rotatable about a central axis, and is operably connected to the vehicle. The check link has a cam surface and a free surface, which is rotated about the central axis relative to the cam surface. A detent assembly is configured to apply a substantially-constant detent force to the check link. An actuator is configured to selectively rotate the check link between at least a holding position and a free position. The holding position aligns the cam surface to be substantially perpendicular to the substantially-constant detent force, and the free position aligns the free surface to be substantially perpendicular to the substantially-constant detent force.

17 Claims, 4 Drawing Sheets

MULTI-PHASE CLOSURE CHECK LINK MECHANISM

TECHNICAL FIELD

This disclosure relates to door or closure systems for vehicles.

BACKGROUND

Many automotive vehicles include a vehicle body defining a passenger compartment. Doors or closures are selectively movable between open and closed positions to permit or obstruct access (ingress and egress) to the passenger, cargo, and other compartments. The doors may be mounted on hinges and may be restrained in the closed position by latches, locks, or similar devices.

SUMMARY

A check link mechanism for a closure is provided. The closure, such as a passenger or cargo door, is pivotally connected to a vehicle and may be configured to open and close relative to the vehicle. The check link mechanism includes a check link rotatable about a central axis. The check link is operably connected to the vehicle and operably connected to the closure through the check link mechanism.

The check link has or includes a cam surface and a free surface. The free surface is rotated about the central axis relative to the cam surface. A detent assembly is configured to provide or apply a substantially-constant detent force to the check link. An actuator is configured to selectively rotate the check link between at least two positions. The positions may include a holding position and a free position. The holding position aligns the cam surface to be substantially perpendicular to the substantially-constant detent force, and the free position aligns the free surface to be substantially perpendicular to the substantially-constant detent force.

The above features and advantages, and other features and advantages, of the present invention are readily apparent from the following detailed description of some of the best modes and other embodiments for carrying out the invention, as defined in the appended claims, when taken in connection with the accompanying drawings.

DETAILED DESCRIPTION

Figure 1:
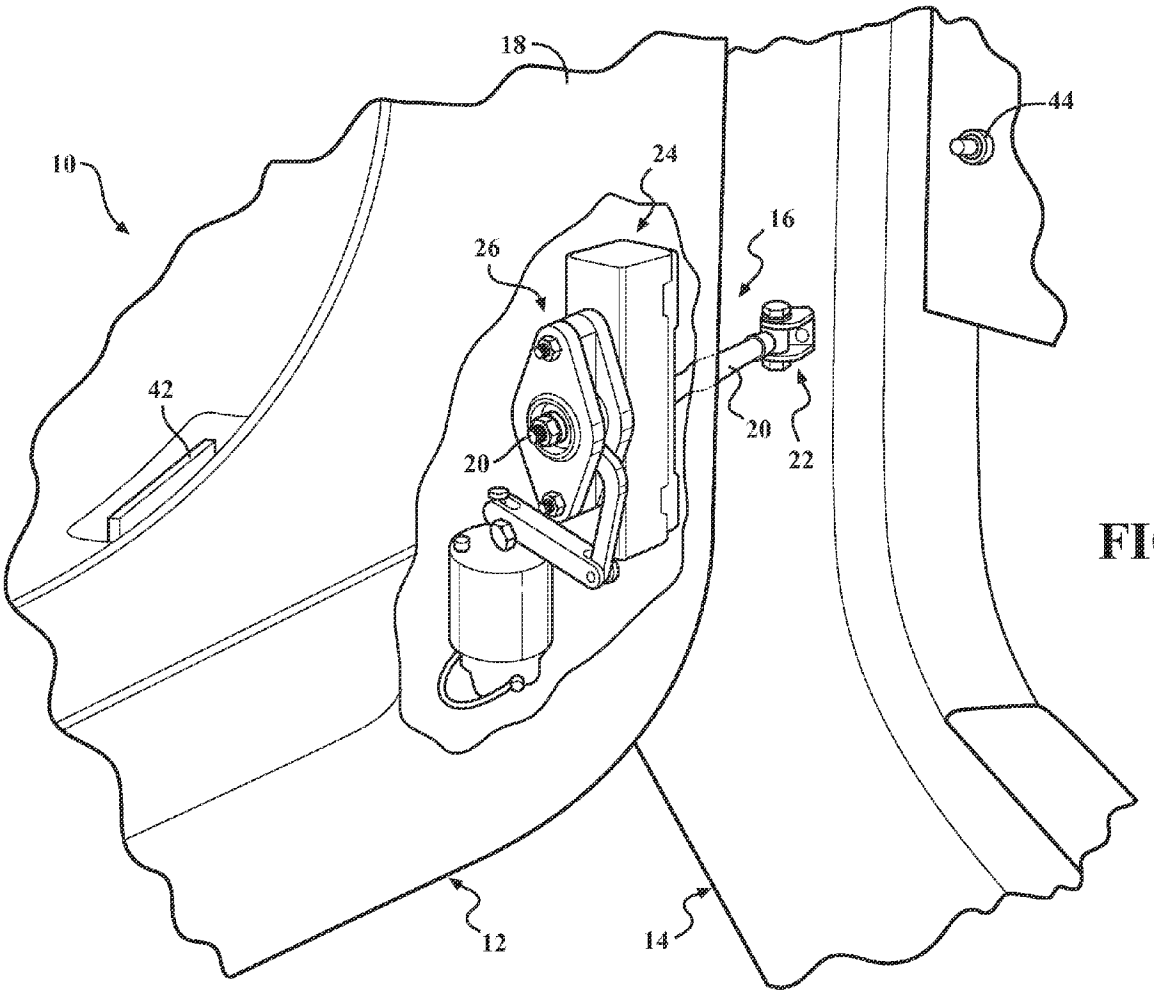
FIG. 1 is a schematic perspective view of a portion of a vehicle, showing a door and a vehicle structure connected by a check link mechanism.

Referring to the drawings, wherein like reference numbers correspond to like or similar components whenever possible throughout the several figures, there is shown in FIG. 1 a schematic diagram of a vehicle 10 (only portions of which are shown). FIG. 1 shows a perspective view of some of the closure components, such as a door 12, which is pivotally connected to a vehicle structure 14 of the vehicle 10. The door 12 is shown in an open position, rotated or pivoted away from the vehicle structure 14, but also closes by rotating back to be flush with the vehicle structure 14.

While the present invention is described in detail with respect to automotive applications, those skilled in the art will recognize the broader applicability of the invention. Those having ordinary skill in the art will recognize that terms such as "above," "below," "upward," "downward," et cetera, are used descriptively of the figures, and do not represent limitations on the scope of the invention, as defined by the appended claims.

A check link mechanism 16 is disposed between the door 12 and the vehicle structure 14. The check link mechanism 16, possibly in combination with one or more hinges (not shown), controls and facilitates opening of the door 12, closing of the door 12, and holding of the door 12 in intermediate positions. The check link mechanism 16 is shown schematically in FIG. 1, and would largely be blocked from view by a trim panel 18 (which is partially removed in FIG. 1 to reveal the check link mechanism 16) in the final assembly of the door 12.

The door 12 shown in FIG. 1 may be a left-side front door (driver's door) or rear door for the vehicle 10, but the schematic drawings are representative of any of the closures which may be found on the vehicle 10. In addition to the door 12, other closures may be used with the check link mechanism 16, such as (without limitation) deck lids or hatch doors.

Figure 2:
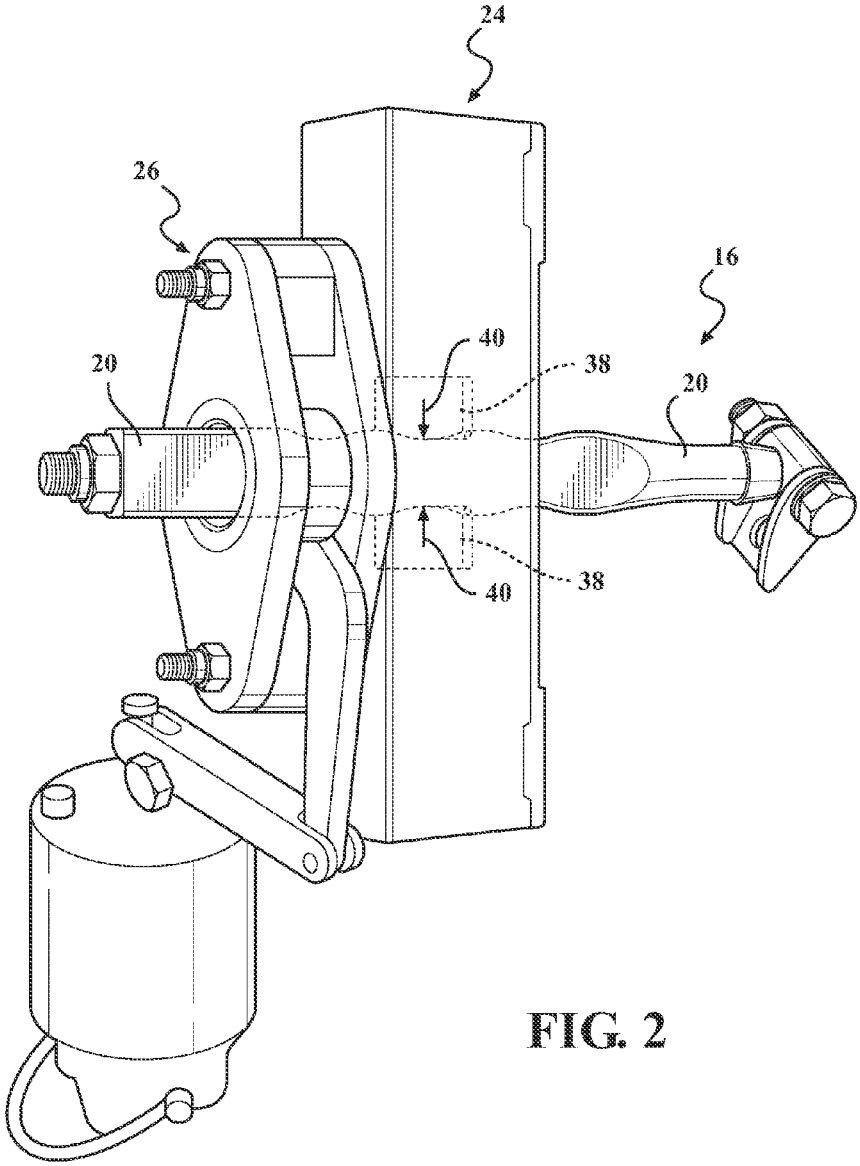
FIG. 2 is schematic perspective view of the check link mechanism shown in FIG. 1, and showing a check link and other interior portion of the check link mechanism.

Referring now to FIG. 2, and with continued reference to FIG. 1, there is shown a more-detailed view of the check link mechanism 16 shown in FIG. 1. The check link mechanism 16 includes a check link 20, which is connected to the vehicle structure 14 via a hinge 22 or similar connection mechanism. The check link 20 cooperates with a detent assembly 24 and an actuator assembly 26 to control the force applied between the door 12 and the vehicle structure 14, and thereby control the position of the door 12 as it swings open and closed. Portions of the check link 20 that are hidden by the detent assembly 24 or the actuator assembly 26 are shown in dashed or phantom lines.

The check link 20 is rotatable about a central axis 28, such as through a journal bearing or other rotatable structures. The check link 20 includes a cam surface 30 and a free surface 32. As described in more detail herein, the detent assembly 24 applies a substantially-constant detent force 40 to the check link 20. The force is applied to either the cam surface 30 or the free surface 32, depending upon the rotational position of the check link 20 relative to the detent assembly 24.

The cam surface 30 has a generally ridged or curved profile that may be grabbed or held by the substantially-constant force 40 from the detent assembly 24. Conversely, the free surface 32 has a profile that generally cannot be grabbed or held by the detent assembly 24.

Figure 3:
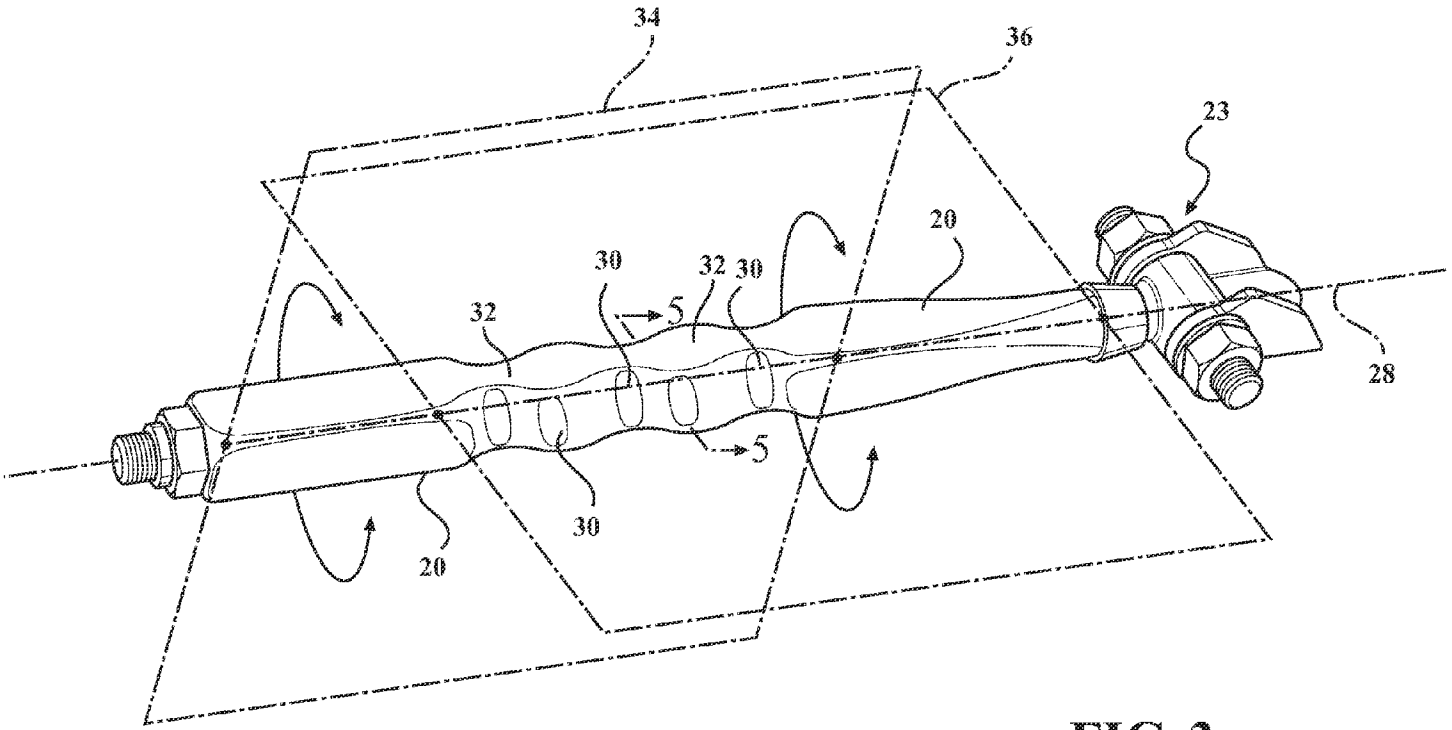
FIG. 3 is schematic perspective view of the check link shown in FIGS. 1 and 2.

Referring now to FIG. 3, and with continued reference to FIGS. 1 and 2, there is shown another view of the check link 20 shown in FIGS. 1 and 2. The check link 20 may include or define a holding plane 34 and a free plane 36, both of which intersect the central axis 28. The free plane 36 is rotated about the central axis 28 relative to the holding plane 34. The center or mid-line of the cam surface 30 is substantially parallel to the holding plane 34 and the center or mid-line of the free surface 32 is substantially parallel to the free plane 36. Therefore, the free surface 32 is also rotated about the central axis 28 relative to the cam surface 30.

In the configuration shown in FIGS. 1-3, the free plane 36 is offset from the holding plane 34 by approximately ninety degrees. However, as shown herein, other angles or rotation between the free plane 36 and the holding place 34 may be used, depending upon the shape of the check link 20.

Figure 4:
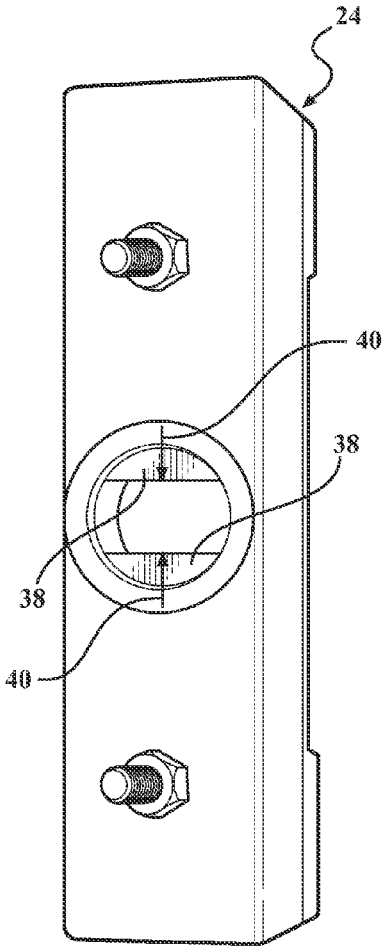
FIG. 4 is schematic perspective view of a detent assembly used with the check link mechanism shown in FIGS. 1 and 2.

Referring now to FIG. 4, and with continued reference to FIGS. 1-3, there is shown another view of the detent assembly 24 shown in FIGS. 1 and 2. As described herein, the detent assembly 24 is configured to provide the substantially-constant detent force 40 to the check link 20.

The detent assembly 24 shown in FIG. 4 applies the substantially-constant detent force 40 via two detent buttons 38. Although not shown in FIG. 4, the check link 20 passes through the detent assembly 24 between the detent buttons 38. The two detent buttons 38 may apply the substantially-constant detent force 40 to opposite sides of the check link 20.

The detent buttons 38 are pressed against the check link 20 by, for example, linear or torsion springs (not shown). The detent buttons 38 are therefore movable (up and down, as viewed in FIG. 4) in the radial direction relative to the check link 20 and the central axis 28. If the detent buttons 38 contact the cam surface 30, the check link 20 will be limited in its ability to move through the detent assembly 24 by the axial force applied between the detent buttons 38 and the cam surface 30. However, if the detent buttons 38 contact the free surface 32, the detent buttons 38 will apply very little force (substantially limited to friction) in the axial direction of the check link 20, which will be free to move through the detent assembly 24.

Referring to FIGS. 1-4, the actuator assembly 26 selectively rotates the check link 20 between a holding position and a free position. The holding position aligns the holding plane 34 of the check link 20 to be substantially perpendicular to the substantially-constant detent force 40, such that the two detent buttons 38 contact the cam surface 30 when the check link 20 is in the holding position. The free position aligns the free plane 36 of the check link 20 to be substantially perpendicular to the substantially-constant detent force 40, such that the two detent buttons 38 contact the free surface 32 when the check link 20 is in the free position.

The check link mechanism 16 may be referred to as a two-phase door check mechanism. Placing the check link 20 in the holding position may also be referred to as placing or setting the check link mechanism 16 to a holding phase or a first phase. Placing the check link 20 in the free position may also be referred to as placing or setting the check link mechanism 16 to a free phase or a second phase.

When the actuator assembly 26 places the check link 20 into the holding position, the detent buttons 38 are in contact with the cam surface 30 of the check link 20. Therefore, relatively high force is required to move the check link 20 axially relative to the detent assembly 24 and to move the door 12 relative to the vehicle structure 14. The amount of force required to the move the door 12 depends upon the shape of the cam surface 30 and the substantially-constant force applied by the detent assembly 24. The holding position may be sufficient to allow the door 12 to be stationary even though gravity (such as when the vehicle 10 is parking on a downhill grade) or wind pressure are trying to force movement of the door.

When the actuator assembly 26 places the check link 20 into the free position, the detent buttons 38 are in contact with the free surface 32 of the check link 20. Therefore, very little force is required to move the check link 20 axially relative to the detent assembly 24 and to move the door 12 relative to the vehicle structure 14. By placing the check link 20 in either the holding position or the free position, the check link mechanism 16 alters the force applied between the detent assembly 24 and the check link 20 and varies the force needed to further open or further close the door 12.

The free surface 32 may be defined as any portion of the check link 20 which is substantially flat or substantially consistent in the axial direction, such that the detent assembly 24 is unable to restrain axial movement of the check link 20. Therefore, the free surface 32 may be considered to begin where the cam surface 30 stops, such that the transition to the free surface 32 occurs whenever rotation makes the check link 20 movable, axially, through the detent assembly 24. Depending upon the transitions between the cam surface 30 and the free surface 32, the amount of axial force applied by the detent buttons 38 may be continuously variable as the check link 20 rotates between the holding position and the free position.

As an operator of the vehicle 10—or the vehicle 10 itself, when the process is automated—applies force to open the door 12, the door 12 swings away from the vehicle structure 14. As the door 12 opens, the detent assembly 24 is drawn outward over the check link 20. During opening of the door 12, the check link 20 may be placed or held in either the holding position or the free position, depending upon the shape of the cam surface 30 of the check link 20 and the force applied by the detent buttons 38.

The cam surface 30 may be configured with lower resistance as the detent assembly 24 draws outward, such that the cam surface 30 allows relatively-easier opening of the door 12 than closing of the door 12 when the check link 20 is in the holding position. Alternatively, the cam surface 30 may be configured to apply approximately the same resistance to movement whether the door 12 is opening or closing. If the cam surface 30 is configured to allow easier opening, the check link 20 may be placed in the holding position during opening of the door 12. However, if the cam surface 30 is not configured to allow easier opening, the actuator assembly 26 may place the check link 20 into the free position during opening of the door 12.

The cam surface 30 shown in FIGS. 1-3 also includes multiple holding points or stops (not separately numbered). These holding points are valleys in the cam surface 30 into which the detent buttons 38 may move when the check link 20 is in the holding position. The holding points introduce axial resistance force (due to inclines leaving the valleys) between the detent buttons 38 and the check link 20. The slope or angle of the holding points determines the amount of force required to push the door 12 further open, if possible, or to pull the door 12 closed. The height differential between the peaks and valleys on the cam surface 30 may also contribute to the axial resistance on the check link 20. Springs (not shown) may be disposed between the door 12 and the vehicle structure 14 to assist the operator opening the door 12, closing the door 12, or both.

When the door 12 is closing, the actuator assembly 26 places the check link 20 into the free position, to substantially remove resistance between the check link 20 and the detent assembly 24. Because the resistance from the detent assembly 24 is substantially removed when the check link 20 is in the free position, the substantially-constant detent force 40 applied by the detent buttons 38 may be relatively high in order to restrain the door 12 from moving when the check link 20 is in the holding position. The actuator assembly 26 may be electronically controlled or commanded, and may be in communication with a vehicle control system or electronic control unit (ECU).

Control of the actuator assembly 26 may also come from a first input device 42 located on the door 12. In the configuration shown in FIG. 1, the first input device 42 is a pull handle oriented such that the operator may grab the first input device 42 as the operator reaches to pull the door 12 closed. If the actuator assembly 26 is an electronic actuator, the first input device 42 may signal (for example and without limitation) a solenoid, motor, or step motor to move the check link 20 into the free position. For electronic actuation, the actuator assembly 26 may also be controlled by a second input device 44 located elsewhere on the vehicle 10, such as (for example and without limitation) a push button or a touch-screen option integrated into navigation, entertainment, or information systems. Alternatively, if the actuator assembly 26 is a mechanical actuator, the first input device 42 may have a mechanical connection, such as (for example and without limitation) a cable or linkage, to the actuator assembly 26.

Figure 5A:
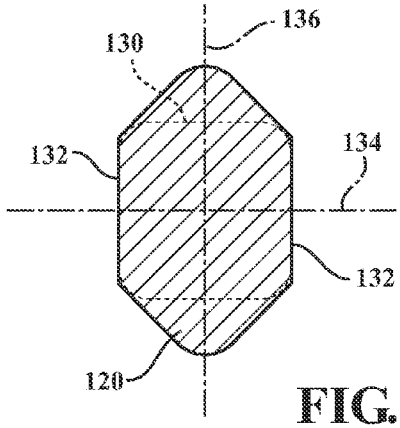
FIG. 5A is schematic cross-sectional view of the check link shown in FIGS. 1 and 2, taken along line 5-5 of FIG. 3.
Figure 5B:
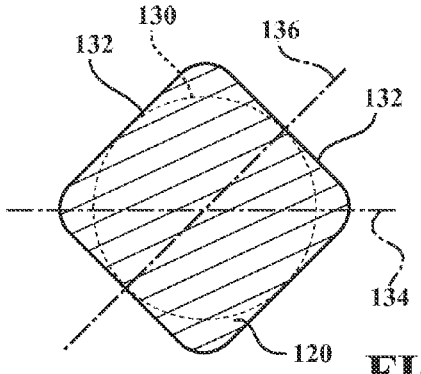
FIG. 5B is schematic cross-sectional view of another check link, which may also be used with the check link mechanism shown in FIGS. 1 and 2, taken along a line similar to the line 5-5 of FIG. 3.
Figure 5C:
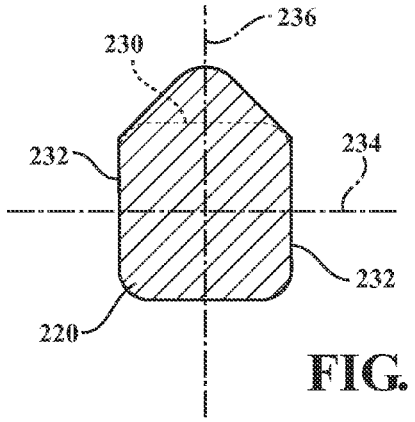
FIG. 5C is schematic cross-sectional view of another check link, which may also be used with the check link mechanism shown in FIGS. 1 and 2, taken along a line similar to the line 5-5 of FIG. 3.

Referring now to FIGS. 5A, 5B, and 5C, and with continued reference to FIGS. 1-4, there are shown three illustrative cross-sectional views of the check link 20 and other, similar check links which may be used with check link mechanism 16 shown in FIGS. 1 and 2. Each of the views shown in to FIGS. 5A, 5B, and 5C is taken either along the section line 5-5 of FIG. 3 or an equivalent line.

FIG. 5A shows the check link 20, including the free surface 32 and the cam surface 30, which is hidden from view and shown in dashed lines. Note that the check link 20 has two free surfaces 32 and two cam surfaces 30. For the check link 20, the free plane 36 is offset from the holding plane 34 by approximately ninety degrees. Therefore, the actuator assembly 26 has to rotate the check link 20 by ninety degrees, in either direction, to move between the holding position and the free position.

FIG. 5B shows a check link 120, which may also be used with the check link mechanism 16 shown in FIGS. 1-2. The check link 120 includes a cam surface 130, which is hidden from view and shown in dashed lines, and a free surface 132. The cam surface 130 is substantially parallel with a holding plane 134 and the free surface 132 is substantially parallel with a free plane 136. Note that the check link 120 has four free surfaces 132 and four cam surfaces 130. Similarly, there are two free planes 136 and two holding planes 134, although only one of each is shown.

For the check link 120, the free plane 136 is offset from the holding plane 134 by approximately forty-five degrees. Therefore, the actuator assembly 26 has to rotate the check link 120 by only forty-five degrees, in either direction, to move between the holding position and the free position.

FIG. 5C shows a check link 220, which may also be used with the check link mechanism 16 shown in FIGS. 1-2. The check link 220 includes a cam surface 230, which is hidden from view and shown in dashed lines, and a free surface 232. The cam surface 230 is substantially parallel with a holding plane 234 and the free surface 232 is substantially parallel with a free plane 236. Note that the check link 220 has three free surfaces 232, but only one cam surface 230.

For the check link 220, the free plane 236 is again offset from the holding plane 234 by approximately ninety degrees. Therefore, the actuator assembly 26 has to rotate the check link 220 by ninety degrees to move between the holding position and the free position. However, because the check link 220 has only one cam surface 230, the direction of rotation may determine whether the check link 220 moves from the free position to the holding position or simply to another free position.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. A check link mechanism for a closure pivotally connected to a vehicle, the check link mechanism comprising:
- a check link rotatable about a central axis and operably connected to the closure and to the vehicle, the check link having:
  - a cam surface, and
  - a free surface, wherein the free surface is rotated about the central axis relative to the cam surface;
- a detent assembly configured to apply a substantially-constant detent force to the check link; and
- an actuator configured to rotate the check link between at least:
  - a holding position, which aligns the cam surface to be substantially perpendicular to the substantially-constant detent force, and
  - a free position, which aligns the free surface to be substantially perpendicular to the substantially-constant detent force.

2. The check link mechanism of claim 1, wherein the free surface is rotated from the cam surface by approximately forty-five degrees.

3. The check link mechanism of claim 1, wherein the free surface is rotated from the cam surface by approximately ninety degrees.

4. The check link mechanism of claim 1, wherein the actuator is a mechanical actuator controlled by a first input device located on the closure, wherein the first input device has a mechanical connection to the actuator.

5. The check link mechanism of claim 1, wherein the detent assembly includes two detent buttons applying the substantially-constant detent force, such that the two detent buttons contact the cam surface when the check link is in the holding position.

6. The check link mechanism of claim 5, wherein the two detent buttons apply the substantially-constant detent force to opposite sides of the check link.

7. The check link mechanism of claim 1, wherein the actuator is an electronic actuator controlled by a first input device located on the closure.

8. The check link mechanism of claim 7, wherein the actuator is also controlled by a second input device located on the vehicle.

9. A check link mechanism for a closure pivotally connected to a vehicle, the check link mechanism comprising:
- a check link rotatable about a central axis and operably connected to the closure and to the vehicle, the check link having:
  - a cam surface, and
  - a free surface, wherein the free surface is rotated about the central axis relative to the cam surface by approximately ninety degrees;
- a detent assembly configured to provide a substantially-constant detent force to the check link; and
- an actuator configured to rotate the check link between at least:

a holding position, which aligns the cam surface to be substantially perpendicular to the substantially-constant detent force, and a free position, which aligns the free surface to be substantially perpendicular to the substantially-constant detent force.

10. The check link mechanism of claim 9, wherein the actuator is an electronic actuator controlled by a first input device located on the closure.

11. The check link mechanism of claim 9, wherein the detent assembly includes two detent buttons applying the substantially-constant detent force, such that the two detent buttons contact the cam surface when the check link is in the holding position.

12. The check link mechanism of claim 11, wherein the two detent buttons apply the substantially-constant detent force to opposite sides of the check link.

13. A check link mechanism for a closure pivotally connected to a vehicle, the check link mechanism comprising:

a check link rotatable about a central axis and operably connected to the closure and to the vehicle, the check link having:

a holding plane intersecting the central axis, a cam surface substantially parallel to the holding plane, a free plane intersecting the central axis, wherein the free plane is rotationally offset from the holding plane, and a free surface substantially parallel to the free plane;

a detent assembly configured to provide a substantially-constant detent force to the check link;

an actuator configured to rotate the check link between at least:

a holding position, which aligns the holding plane to be substantially perpendicular to the substantially-constant detent force, such that the detent assembly applies the substantially-constant force to the cam surface, and a free position, which aligns the free plane to be substantially perpendicular to the substantially-constant detent force, such that the detent assembly applies the substantially-constant force to the free surface.

14. The check link mechanism of claim 13, wherein the free plane is offset from the holding plane by approximately ninety degrees.

15. The check link mechanism of claim 13, wherein the free plane is offset from the holding plane by approximately forty-five degrees.

16. The check link mechanism of claim 13, wherein the detent assembly includes two detent buttons applying the substantially-constant detent force, such that the two detent buttons contact the cam surface when the check link is in the holding position.

17. The check link mechanism of claim 16, wherein the two detent buttons apply the substantially-constant detent force to opposite sides of the check link.

* * * * *